US011605354B2

(12) United States Patent
Hong

(10) Patent No.: US 11,605,354 B2
(45) Date of Patent: Mar. 14, 2023

(54) DISPLAY DEVICE, DRIVING CIRCUIT AND DRIVING METHOD OF DISPLAY DEVICE

(71) Applicant: LG Display Co., Ltd., Seoul (KR)

(72) Inventor: MooKyoung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/518,445

(22) Filed: Nov. 3, 2021

(65) Prior Publication Data

US 2022/0148515 A1 May 12, 2022

(30) Foreign Application Priority Data

Nov. 11, 2020 (KR) ..... 10-2020-0150091

(51) Int. Cl.
*G09G 3/3275* (2016.01)

(52) U.S. Cl.
CPC ... *G09G 3/3275* (2013.01); *G09G 2300/0842* (2013.01); *G09G 2310/0291* (2013.01); *G09G 2310/08* (2013.01); *G09G 2370/10* (2013.01)

(58) Field of Classification Search
CPC .... G09G 3/2096; G09G 5/006; G09G 3/3275; G09G 2310/0275; G09G 2310/0291; G09G 2370/14; G09G 2370/08; G09G 2300/0842; G09G 2370/10; G09G 2310/08
See application file for complete search history.

(56) References Cited

U.S. PATENT DOCUMENTS

2013/0285998 A1* 10/2013 Hong ..... G06F 3/038 345/212
2014/0118235 A1* 5/2014 Hong ..... G09G 5/008 345/87
2016/0365066 A1* 12/2016 Lim ..... G09G 3/2096
2018/0190238 A1* 7/2018 Park ..... G09G 3/2092

* cited by examiner

*Primary Examiner* — Shaheda A Abdin
(74) *Attorney, Agent, or Firm* — Fenwick & West LLP

(57) ABSTRACT

Embodiments of the present disclosure relate to a display device, a driving circuit and a driving method. According to an embodiment of the present disclosure, it is possible to actively control the output characteristics of data packets in a display device using a point-to-point interface. In addition, according to embodiments of the present disclosure, it is possible to actively control the output characteristics of data packets by determining a connection status or signal transmission characteristics between a timing controller and the driving circuit in a display device using a point-to-point interface.

17 Claims, 11 Drawing Sheets

FIG. 10

| Td | VID | EQ | PE (Pre-emphasis) |
|---|---|---|---|
| 100ns | 400mV | 6dB | 50% |
| 200ns | 450mV | 8dB | 100% |
| 300ns | 450mV | 10dB | 100% |

DISPLAY DEVICE, DRIVING CIRCUIT AND DRIVING METHOD OF DISPLAY DEVICE

CROSS REFERENCE TO RELATED APPLICATION

This application claims priority from Republic of Korea Patent Application No. 10-2020-0150091, filed on Nov. 11, 2020, which is hereby incorporated by reference in its entirety.

TECHNICAL FIELD

The present disclosure relates to a display device, a driving circuit and a driving method of a display device.

BACKGROUND

As the information society develops, the demand for display devices for displaying images is increasing in various forms. Various types of display devices such as a liquid crystal display device (LCD) and an organic light emitting display device (OLED) have been used for this purpose.

Among such display devices, the organic light emitting display device utilizes an organic light emitting diode emitting light by itself, so that there may have advantages in the rapid response speed, contrast ratio, luminous efficiency, luminance and viewing angle.

Such a display device may include light emitting elements disposed in each of a plurality of subpixels arranged on a display panel, so that it is possible to control the luminance displayed in each subpixel and display the image by controlling the voltage or current flowing through the light emitting element to emit light.

Recently, as the resolution increases along with high-speed driving of display devices, the number of subpixels and data lines supplying a data voltage to the subpixels increase, and various signal lines are required between the driving circuit for driving the display panel and the timing controller controlling the driving circuit.

Accordingly, in order to reduce the number of signal lines placed between the timing controller and the driving circuit and to stabilize signal transmission, an interface that serializes digital image data, inserts clock information, converts into a packet unit and transmits a data packet in a point-to-point manner is being researched.

In such a point-to-point interface, it is necessary to control the output characteristics of the transmitted data packets according to the connection status or signal transmission characteristics between the timing controller and the driving circuit. In particular, since the length of the cable connecting the timing controller and the driving circuit varies according to the size and type of the display device, it is necessary to control the output characteristics of the data packet in consideration of the signal delay occurring between the timing controller and the driving circuit.

However, since there is no way to determine the connection status or signal transmission characteristics between the timing controller and the driving circuit in a display device using a point-to-point interface, there is a problem in that it is difficult to actively control the output characteristics of data packets in the timing controller.

SUMMARY

Embodiments of the present disclosure may provide a display device, a driving circuit and a driving method capable of actively controlling the output characteristics of data packets in a display device using a point-to-point interface.

In addition, embodiments of the present disclosure may provide a display device, a driving circuit and a driving method capable of actively controlling the output characteristics of data packets by determining a connection status or signal transmission characteristics between a timing controller and the driving circuit in a display device using a point-to-point interface.

In one aspect, embodiments of the present disclosure may provide a display device including a display panel in which a plurality of gate lines, a plurality of data lines, and a plurality of subpixels are disposed, a gate driving circuit for driving the plurality of gate lines, a data driving circuit for driving the plurality of data lines, bypassing a lock input signal in a first period, and receiving a data packet in a second period, and a timing controller is configured to, control the gate driving circuit and the data driving circuit, detect a delay time of the lock input signal bypassed through the data driving circuit in the first period by using a point-to-point interface which serializes digital image data and inserts clock information to transmit the data packet, and control an output characteristic of the data packet transmitted to the data driving circuit in the second period.

In one aspect, the data driving circuit may include a plurality of source driving integrated circuits connected in series, wherein the lock input signal may be sequentially transmitted through the plurality of source driving integrated circuits, and the data packets may be transmitted from the timing controller to the plurality of source driving integrated circuits, respectively.

In one aspect, the lock input signal may be transmitted in the form of a pulse in the first period.

In one aspect, the data packet may include a clock training pattern for synchronizing an internal clock, a data control signal for controlling the data driving circuit, and the digital image data for displaying an image on the display panel.

In one aspect, the data driving circuit may include a clock recovery circuit for generating the internal clock using the data packet and generating a high level lock output signal if a phase of the internal clock is locked, a logic circuit for receiving an output of the clock recovery circuit and the lock input signal, and a mode switch connected to an output node of the logic circuit and the lock input signal to bypass the lock input signal in the first period.

In one aspect, the lock output signal may be a signal indicating whether the phase of the internal clock is locked.

In one aspect, the data driving circuit may include a receiving buffer for receiving the data packet, a reception characteristic control circuit for controlling reception characteristics of the receiving buffer, an unpacker separating the data packet transmitted through the receiving buffer, a data processing circuit for converting the digital image data of a serial structure separated through the unpacker into a data of a parallel structure, and a phase comparison circuit for comparing the phase of an input clock included in the data packet and the internal clock.

In one aspect, the output characteristic may include at least one of a differential input voltage characteristic indicating a maximum voltage level of the data packet output from the timing controller, an equalizing characteristic indicating an equalizing level of the data packet received by the data driving circuit, and a pre-emphasis characteristic indicating a ratio of a maximum peak-to-peak voltage and a minimum peak-to-peak voltage of the data packet output from the timing controller.

In one aspect, a characteristic value of the output characteristic may increase as the delay time increases.

In one aspect, the timing controller may include a data processing circuit for aligning a clock training pattern, a data control signal and the digital image data into a serial data signal, a clock generation circuit for generating an input clock of the data packet, a packer for embedding the input clock in the serial data signal, a transmission buffer for converting the serial data signal input from the packer into the data packet of a differential signal and transmitting the data packet, and an output characteristic control circuit for controlling output characteristic of the data packet.

In another aspect, embodiments of the present disclosure may provide a driving circuit including a clock recovery circuit for, through a point-to-point interface which serializes digital image data and inserts clock information to transmit a data packet, generating an internal clock using the data packet received during a display driving period, and generating a high level lock output signal when a phase of the internal clock is locked, a logic circuit for receiving an output of the clock recovery circuit and a lock input signal, and a mode switch connected to an output node of the logic circuit and the lock input signal to bypass the lock input signal in a bypass period.

In another aspect, embodiments of the present disclosure may provide a driving method of a display device which serializes digital image data and inserts clock information to transmit a data packet in a point-to-point interface including bypassing a lock input signal in the form of a pulse through a data driving circuit, detecting a delay time between a timing controller and the data driving circuit, controlling output characteristic of the data packet according to a degree of the delay time, and transmitting the data packet according to the output characteristic.

According to an embodiment of the present disclosure, it is possible to actively control the output characteristics of data packets in a display device using a point-to-point interface.

In addition, according to embodiments of the present disclosure, it is possible to actively control the output characteristics of data packets by determining a connection status or signal transmission characteristics between a timing controller and the driving circuit in a display device using a point-to-point interface.

BRIEF DESCRIPTION OF THE DRAWINGS

FIG. 10 illustrates an example in which an output characteristic of a timing controller is controlled according to a delay time for signal transmission in a display device according to embodiments of the present disclosure.

DETAILED DESCRIPTION

Figure 1:
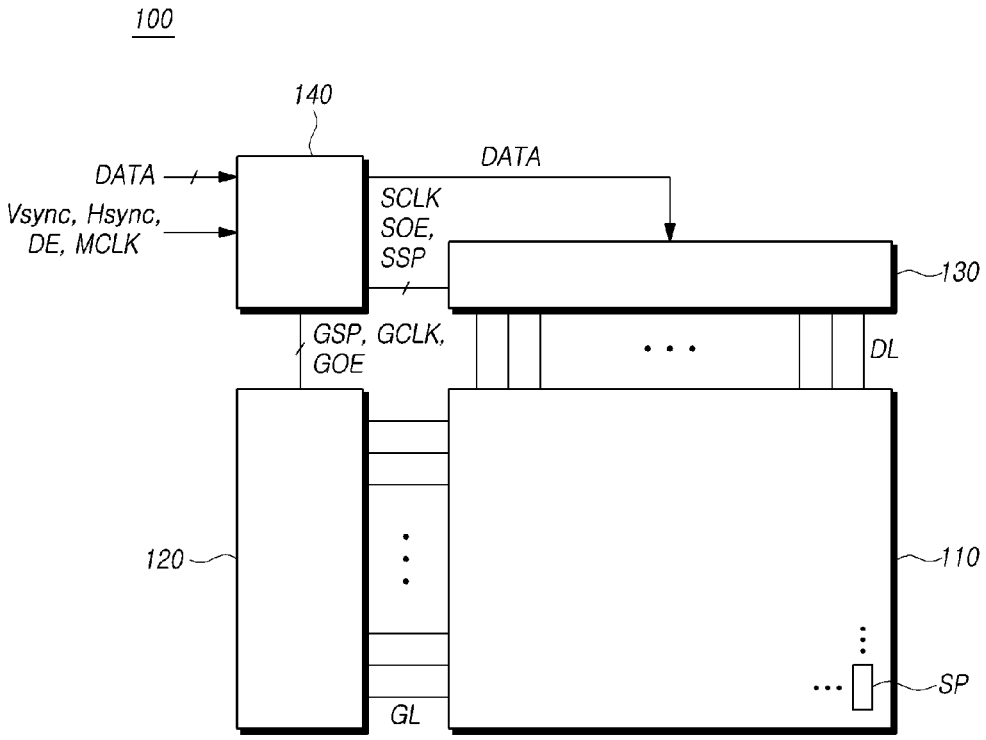
FIG. 1 illustrates a schematic configuration of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a schematic configuration of a display device according to embodiments of the present disclosure.

Referring to FIG. 1, a display device 100 according to embodiments of the present disclosure may include a display panel 110 in which a plurality of gate lines GL and data lines DL are connected, and a plurality of subpixels SP are arranged in a matrix form, a gate driving circuit 120 driving a plurality of gate lines GL, data driving circuit 130 for supplying a data voltage through a plurality of data lines DL, and a timing controller 140 that controls the gate driving circuit 120 and the data driving circuit 130.

The display panel 110 may display the image based on a scan signal transmitted from the gate driving circuit 120 through a plurality of gate lines GL and a data voltage transmitted from the data driving circuit 130 through a plurality of data lines DL.

In the case of a liquid crystal display (LCD), the display panel 110 includes a liquid crystal layer formed between two substrates, and may be operated in any known mode such as twisted nematic (TN) mode, vertical alignment (VA) mode, in-plane switching (IPS) mode, fringe field switching (FFS) mode. On the other hand, in the case of an organic light-emitting display (OLED), the display panel 110 may be implemented in a top emission method, a bottom emission method, or a dual emission method.

In the display panel 110, a plurality of pixels may be arranged in a matrix form, and each pixel may composed of a subpixel SP having a different color, for example, a white subpixel, a red subpixel, a green subpixel, and a blue subpixels, and each subpixel SP may be defined by a plurality of data lines DL and a plurality of gate lines GL.

One subpixel SP may include a thin film transistor (TFT) formed in a region where one data line DL and one gate line GL intersect, a light emitting element such as organic light emitting diode for charging the data voltage, and a storage capacitor for maintaining a voltage by being electrically connected to the light emitting element.

For example, in the case of the WRGB display device 100 having a resolution of 2,160×3,840, the 2,160 gate lines GL and all 3,840×4=15,360 data lines DL may be provided by 3,840 data lines DL respectively connected to the four subpixels WRGB, and subpixels SP may be disposed at points where these gate lines GL and data lines DL intersect with each other.

The gate driving circuit 120 may be controlled by the timing controller 140, and may sequentially output scan signals to a plurality of gate lines GL disposed on the display panel 110, so aa to control driving timing for a plurality of subpixels SP.

In the display device 100 having a resolution of 2,160×3,840, a case in which scan signals are sequentially output from the first gate line to the 2,160 gate lines for 2,160 gate lines GL may be referred to as 2,160 phase driving. Alternatively, a case in which scan signals are sequentially outputted in units of four gate lines GL, such as a case of sequentially outputting scan signals from the first gate line to the fourth gate line and then sequentially outputting the scan signals from the fifth gate line to the eighth gate line, may be referred to as 4-phase driving. That is, a case in which scan signals are sequentially output for every N gate lines GL may be referred to as N-phase driving.

In this case, the gate driving circuit 120 may include one or more gate driving integrated circuits (GDIC), and may be located on only one side or both sides of the display panel 110 according to a driving method. Alternatively, the gate driving circuit 120 may be embedded in a bezel area of the display panel 110 and implemented in a GIP (Gate-in-panel) form.

The data driving circuit 130 receives digital image data DATA from the timing controller 140, converts the digital image data into an analog data voltage. The data driving circuit 130 then outputs the data voltage to each data line DL according to the timing at which the scan signal is applied through the gate line GL, so that each subpixel SP connected to the data line DL displays a light emission signal of brightness corresponding to the data voltage.

Similarly, The data driving circuit 130 may include one or more source driving integrated circuits (SDIC), and the source driving integrated circuit SDIC may be connected to a bonding pad of the display panel 110 in a TAB (Tape Automated Bonding) method or a COG (Chip-on-glass) method, or may be directly disposed on the display panel 110.

In some cases, each source driving integrated circuit (SDIC) may be integrated and disposed on the display panel 110. In addition, each source driving integrated circuit (SDIC) may be implemented in a COF (Chip-on-film) method. In this case, each source driving integrated circuit (SDIC) may be mounted on a circuit film, and may be electrically connected to the data line DL of the display panel 110.

The timing controller 140 may supply various control signals to the gate driving circuit 120 and the data driving circuit 130 and may control operations of the gate driving circuit 120 and the data driving circuit 130. That is, the timing controller 140 controls the gate driving circuit 120 to output the scan signal according to the timing implemented in each frame, and transfers the digital image data DATA received from the outside to the data driving circuit 130.

In this case, the timing controller 140 may receive various timing signals including a vertical synchronization signal Vsync, a horizontal synchronization signal Hsync, a data enable signal DE, a main clock signal MCLK together with digital image data DATA from an external (e.g., host system). Accordingly, the timing controller 140 may generate a control signal using various timing signals received from the outside, and may transmit the control signal to the gate driving circuit 120 and the data driving circuit 130.

For example, in order to control the gate driving circuit 120, the timing controller 140 may output a plurality of gate control signal including a gate start pulse signal GSP, a gate clock GCLK, and a gate output enable signal GOE. Here, the gate start pulse signal GSP controls the timing at which one or more gate driving integrated circuits GDIC constituting the gate driving circuit 120 start to operate. In addition, the gate clock GCLK is a clock signal commonly input to one or more gate driving integrated circuits GDIC, and controls shift timing of the scan signal. In addition, the gate output enable signal GOE designates timing information of one or more gate driving integrated circuits GDIC.

In addition, in order to control the data driving circuit 130, the timing controller 140 may output a plurality of data control signals including a source start pulse SSP, a source sampling clock SCLK, and a source output enable signal SOE. Here, the source start pulse SSP controls the timing at which one or more source driving integrated circuits SDIC constituting the data driving circuit 130 start data sampling. The source sampling clock SCLK is a clock signal that controls the timing of sampling data in the source driving integrated circuit SDIC. The source output enable signal SOE controls the output timing of the data driving circuit 130.

Such a display device 100 may further include a power management integrated circuit that supplies various voltages or currents to the display panel 110, the gate driving circuit 120, the data driving circuit 130, or the like, or controls various voltages or currents to be supplied.

Meanwhile, the subpixel SP is located at a region where the gate line GL and the data line DL cross each other, and a light emitting element may be disposed in each subpixel SP. For example, the organic light emitting display device includes a light emitting element such as an organic light emitting diode in each subpixel SP, and may display an image by controlling a current flowing through the light emitting element according to a data voltage.

The display device 100 may be various types of devices such as a liquid crystal display, an organic light emitting display, and a plasma display panel.

Figure 2:
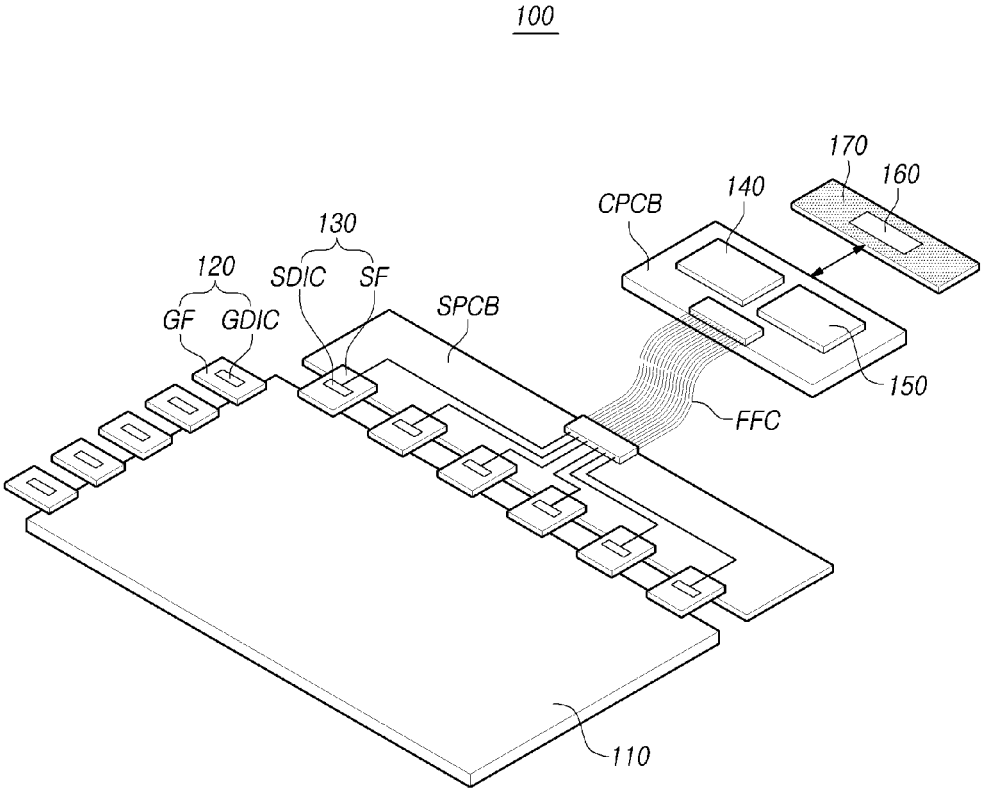
FIG. 2 is an exemplary system diagram of a display device according to embodiments of the present disclosure.

FIG. 2 is an exemplary system diagram of a display device according to embodiments of the present disclosure.

FIG. 2 illustrates the case in which, in the display device 100 according to the exemplary embodiment of the present disclosure, the source driving integrated circuit (SDIC) included in the data driving circuit 130 is implemented in a chip-on-film (COF) method among various methods (TAB, COG, COF, etc.), and the gate driving circuit 120 is implemented in a gate-in-panel (GIP) method form among various methods (TAB, COG, COF, GIP, etc.)

At least one gate driving integrated circuit GDIC included in the gate driving circuit 120 may be mounted on the gate film GF, respectively, and one side of the gate film GF may be electrically connected to the display panel 110. Also, lines for electrically connecting the gate driving integrated circuit GDIC and the display panel 110 may be disposed on the gate film GF.

Similarly, at least one source driving integrated circuit SDIC included in the data driving circuit 130 may be mounted on each source film SF, and one side of the source film SF may be electrically connected to the display panel 110. Also, lines for electrically connecting the source driving integrated circuit SDIC and the display panel 110 may be disposed on the source film SF.

The display device 100 may include at least one source printed circuit board SPCB and a control printed circuit board CPCB for mounting control components and various electric devices in order to connect a plurality of source driving integrated circuits SDIC and other devices.

In this case, the other side of the source film SF on which the source driving integrated circuit SDIC is mounted may be connected to the at least one source printed circuit board SPCB. That is, one side of the source film SF on which the source driving integrated circuit SDIC is mounted may be electrically connected to the display panel 110, and the other side thereof may be electrically connected to the source printed circuit board SPCB.

A timing controller 140 and a power management integrated circuit PMIC 150 may be mounted on the control printed circuit board CPCB. The timing controller 140 may control operations of the data driving circuit 130 and the gate driving circuit 120. The power management integrated circuit 150 may supply a driving voltage or current to the display panel 110, the data driving circuit 130, the gate driving circuit 120, and the like, and may control the supplied voltage or current.

At least one source printed circuit board SPCB and a control printed circuit board CPCB may be circuitly connected through at least one connection member, and the connection member may include, for example, a flexible printed circuit FPC, a flexible flat cable FFC, or the like. In addition, at least one of the source printed circuit board SPCB and the control printed circuit board CPCB may be implemented by being integrated into one printed circuit board.

The display device 100 may further include a set board 170 electrically connected to a control printed circuit board CPCB. In this case, the set board 170 may be referred to as a power board. The set board 170 may include a main power management circuit 160 that manages the total power of the display device 100. The main power management circuit 160 may be linked with the power management integrated circuit 150.

In the case of the display device 100 having the above configuration, the driving voltage may be generated at the set board 170 and transmitted to the power management integrated circuit 150 in the control printed circuit board CPCB. The power management integrated circuit 150 may transmit the driving voltage required for driving a display or sensing a characteristic value to a source printed circuit board SPCB through a flexible printed circuit FPC or a flexible flat cable FFC. The driving voltage transmitted to the source printed circuit board SPCB may be supplied to emit or sense a specific subpixel SP in the display panel 110 through the source driving integrated circuit SDIC.

In this case, each of the subpixels SP arranged on the display panel 110 in the display device 100 may include an organic light emitting diode, which is a light emitting element, and a circuit element such as a driving transistor for driving the subpixel SP.

The type and number of circuit elements constituting each subpixel SP may be variously determined according to a provision function and a design method.

The display device of the present disclosure may use a point-to-point interface which serializes digital image data DATA, inserts clock information to convert into and transmit packet units, in order to reduce the number of signal lines connecting the timing controller 140 mounted on the control printed circuit board CPCB and the data driving circuit 130 mounted on the source printed circuit board SPCB and to stabilize signal transmission.

Figure 3:
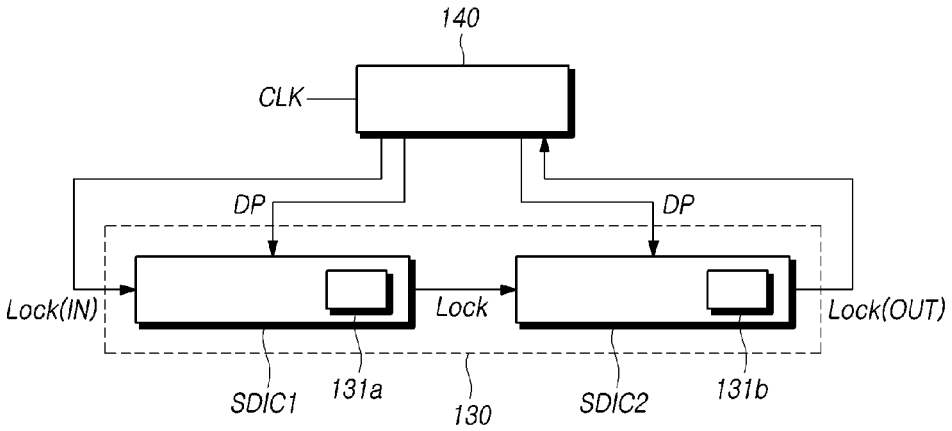
FIG. 3 illustrates an exemplary structure of a point-to-point interface in a display device according to embodiments of the present disclosure.
Figure 4:
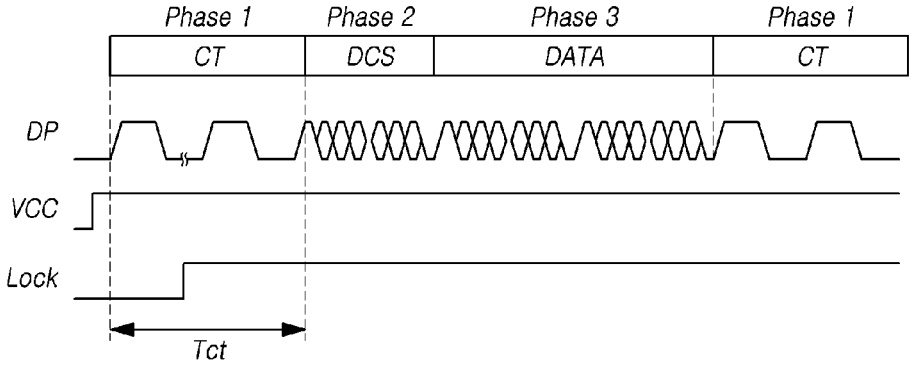
FIG. 4 illustrates an example of a waveform of a signal transmitted from a point-to-point interface in a display device according to embodiments of the present disclosure.

FIG. 3 illustrates an exemplary structure of a point-to-point interface in a display device according to embodiments of the present disclosure, and FIG. 4 illustrates an example of a waveform of a signal transmitted from a point-to-point interface in a display device according to embodiments of the present disclosure.

Referring to FIG. 3 and FIG. 4, a display device 100 according to embodiments of the present disclosure may include a timing controller 140 for transmitting a plurality of data packets DP and a data driving circuit 130 for receiving a plurality of data packets DP transmitted from the timing controller 140.

The interface specification exemplified here is an embedded point-to-point interface (EPI) which serializes data control signal DCS and digital image data DATA, inserts clock information, converts it into packet units, and transmits data packets DP, in order to reduce the number of data transmission lines between the timing controller 140 and the data driving circuit 130 and to perform high-speed transmission.

Here, it is exemplary described a structure in which the timing controller 140 transmits the data packet DP, receives the data packet DP from the data driving circuit 130 including two source driving integrated circuits SDIC1, SDIC2, and supplies the data packet DP to the display panel 110.

The timing controller 140 may serially transmit a plurality of data packets DP to the data driving circuit 130 according to a clock signal CLK.

In this case, the data packet DP transmitted by the timing controller 140 may be divided into a first transmission period, a second transmission period, and a third transmission period.

In the first transmission period, clock training for synchronizing the clock signal CLK may be performed using the clock training pattern CT. In the second transmission period, a data control signal DCS for controlling the data driving circuit 130 may be transmitted, and image data DATA may be transmitted in the third transmission period. However, the section in which the data packet DP is transmitted and the type of transmitted data may be displayed in various ways.

In a horizontal blank time or a vertical blank time, the timing controller 140 may synchronize the clock signal CLK by performing clock training with the data driving circuit 130 during the clock training time Tct.

The timing controller 140 may transmit a lock input signal Lock(IN) to the data driving circuit 130 while being synchronized with the data driving circuit 130 through clock training. In addition, the timing controller 140 may receive feedback of the lock output signal Lock(OUT) from the data driving circuit 130.

If the phase of an internal clock signal is locked, the first source driving integrated circuit SDIC1 may generate a lock signal of a high logic level indicating a stable state of the output and transmit to the adjacent second source driving integrated circuit SDIC2. In this case, the lock signal Lock generated by the last source driving integrated circuit (SDIC2 in this case) of the data driving circuit 130 may be the lock output signal Lock(OUT) of the data driving circuit 130, and the lock output signal Lock(OUT) may be transmitted to the timing controller 140 through a signal lines connected between the timing controller 140 and the last source driving integrated circuit SDIC2. In this case, a high-level DC power supply voltage VCC is input to the lock signal (Lock(IN), Lock) input terminals of the source driving integrated circuits SDIC1, SDIC2.

In the case that a normal lock output signal Lock(OUT) is received through the data driving circuit 130, the timing controller 140 may transmit a data packet DP corresponding to a plurality of source driving integrated circuits SDIC1, SDIC2 constituting the data driving circuit 130.

In this case, the specification of the embedded point-to-point interface (EPI) may not use a line for transmitting the clock signal CLK between the timing controller 140 and the data driving circuit 130 in order to reduce the transmission line. In this case, when the timing controller 140 transmits the data packet DP, the data driving circuit 130 may generate an internal clock signal in a clock recovery circuits 131*a*, 131*b* using the received data packet DP, and transmit digital image data DATA in response to the generated internal clock signal.

In this case, the data driving circuit 130 may compare the internal clock signal generated by the clock recovery circuits 131*a*, 131*b* with the clock training pattern transmitted from the timing controller 140, and may transmit a high level lock output signal Lock(OUT) to the timing controller 140 if there is no abnormality as a result of the comparison.

Meanwhile, the lock output signal Lock(OUT) transmitted from the data driving circuit 130 to the timing controller 140 may be a signal obtained by feeding back a lock input signal Lock(IN) transmitted from the timing controller 140 to the data driving circuit 130.

In a state in which the lock output signal Lock(OUT) is transmitted to the timing controller 140, the data driving circuit 130 may lock or fix the phase and frequency of the synchronized data packet DP through clock training. Therefore, there may be in a state capable of receiving the data packet DP transmitted from the timing controller 140.

In this case, if a point-to-point interface is used, the timing controller 140 may control an output characteristic of the transmitted data packet DP according to a connection state with the data driving circuit 130 or a signal transmission characteristic. In particular, since the length of a cable (e.g., flexible flat cable FFC) connecting the timing controller 140 and the data driving circuit 130 varies according to the size and type of the display device 100, it is preferable to control the output characteristics of the data packet DP in consideration of the signal delay appearing between the timing controller 140 and the data driving circuit 130.

To this end, the display device 100 of the present disclosure using a point-to-point interface may determine a signal transmission characteristic between the timing controller 140 and the data driving circuit 130, thereby actively controlling the output characteristic of the data packet DP generated by the controller 140.

Figure 5:
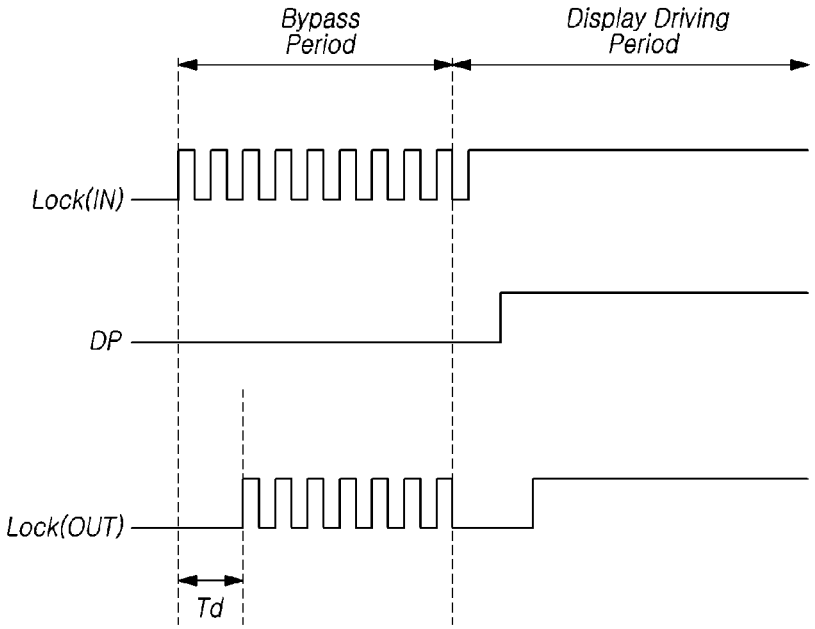
FIG. 5 illustrates an example of a waveform of a point-to-point interface signal in a display device according to embodiments of the present disclosure.

FIG. 5 illustrates an example of a waveform of a point-to-point interface signal in a display device according to embodiments of the present disclosure.

Referring to FIG. 5, the display device according to embodiments of the present disclosure may include a bypass period for determining signal transmission characteristics between the timing controller 140 and the data driving circuit 130 prior to a display driving period for transmitting the data packet DP to the data driving circuit 130.

During the bypass period, the timing controller 140 transmits the lock input signal Lock(IN) to the data driving circuit 130, but does not transmit the data packet DP. Accordingly, the data driving circuit 130 does not generate an internal clock in the clock recovery circuit, and the plurality of source driving integrated circuits SDIC included in the data driving circuit 130 bypass the lock input signal Lock(IN) transmitted from the timing controller 140 to transmit the lock output signal Lock(OUT) having the same waveform as the lock input signal Lock(IN) to the timing controller 140.

In this case, the lock input signal Lock(IN) generated by the timing controller 140 during the bypass period may have a specific delay time Td while passing through the signal line (e.g., FFC) connecting the control printed circuit board CPCB and the source printed circuit board SPCB and the data driving circuit 130.

Accordingly, the timing controller 140 may receive the lock output signal Lock(OUT) transmitted from the data driving circuit 130 after a specific delay time Td. Therefore, the timing controller 140 may detect a delay time Td occurring in a signal transmission process to the data driving circuit 130 by comparing with the lock input signal Lock (IN) supplied to the data driving circuit 130.

In this case, the lock input signal Lock(IN) generated by the timing controller 140 during the bypass period is transmitted in the form of a pulse signal in order to more accurately and quickly detect the delay time Td with the lock output signal Lock(OUT) transmitted from the data driving circuit 130.

If the delay time Td between the lock input signal Lock(IN) transmitted from the timing controller 140 in the bypass period and the lock output signal Lock(OUT) received from the data driving circuit 130 is detected, there may be set the output characteristic of the data packet DP transmitted to the data driving circuit 130 during the display driving period based on the delay time Td.

When the output characteristics of the data packet DP are set based on the delay time Td of the lock signals Lock(IN) and Lock(OUT), the timing controller 140 may transmit the data packet DP generated according to the output characteristics set during the display driving period to the data driving circuit 130.

The data driving circuit 130 synchronizes the internal clock through clock training with respect to the clock training pattern CT included in the received data packet DP, and receives the data control signal DCS and the digital image data DATA according to the synchronized clock.

Accordingly, before transmitting the data packet DP, the timing controller 140 may determine the characteristics of the signal being transmitted to the data driving circuit 130 during the bypass period, so that the output characteristics of the data packet DP transmitted to the data driving circuit 130 may be actively controlled and the image quality of the display apparatus 100 may be improved.

Figure 6:
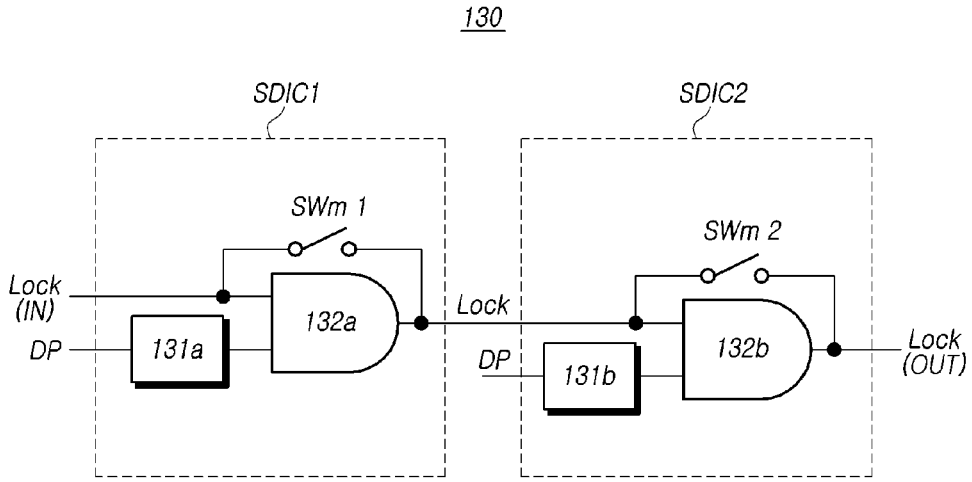
FIG. 6 illustrates an example of a data driving circuit for a point-to-point interface operation in a display device according to embodiments of the present disclosure.

FIG. 6 illustrates an example of a data driving circuit for a point-to-point interface operation in a display device according to embodiments of the present disclosure.

Here, it is illustrated a case in which the data driving circuit 130 is configured of two source driving integrated circuits SDIC1, SDIC2 as an example to correspond to FIG. 3.

Referring to FIG. 6, in the display device 100 according to embodiments of the present disclosure, the data driving circuit 130 for the point-to-point interface operation may include a plurality of source driving integrated circuits SDIC1, SDIC2 that sequentially transmit the lock input signal Lock(IN) transmitted from the timing controller 140. In this case, the plurality of source driving integrated circuits SDIC1, SDIC2 may respectively receive the data packet DP from the timing controller 140.

The plurality of source driving integrated circuits SDIC1, SDIC2 may include clock recovery circuits 131*a*, 131*b* and a logic circuit, respectively. Here, the logic circuit is a circuit capable of generating high-level or low-level output signals Lock and Lock(OUT) according to the outputs of the clock recovery circuits 131*a*, 131*b* and the lock signals Lock(IN) and Lock, and it has been illustrated, as an example, the case constituting AND gates 132*a*, 132*b*. Accordingly, it will be apparent that the logic circuit can be changed into various structures capable of changing the level of the output according to the output of the clock recovery circuits 131*a*, 131*b* and the lock signals Lock(IN), Lock.

The AND gates 132*a*, 132*b* receive the outputs of the clock recovery circuits 131*a*, 131*b* and the lock signals Lock(IN) and Lock to generate output signals Lock, Lock (OUT). In addition, the AND gates 132*a*, 132*b* may include mode switches SWm1, SWm2 capable of bypassing the lock signals Lock(IN), Lock.

Specifically, the clock recovery circuit 131*a* of the first source driving integrated circuit SDIC1 generates an internal clock signal using the data packet DP transmitted from the timing controller 140 during the display driving period, and, transmits a high-level logic signal to the AND gate 131*b* if the internal clock signal is normally generated.

The AND gate 131*b* of the first source driving integrated circuit SDIC1 receives the output signal of the clock recovery circuit 131*a* and the lock input signal Lock(IN) transmitted from the timing controller 140, and transmits the high-level output signal Lock to the second source driving integrated circuit SDIC2 in the case that the internal clock signal is normally generated and the high-level lock input signal Lock(IN) is input from the timing controller 140.

In this case, the mode switch SWm1 connected to the AND gate 131*b* is turned on during the bypass period before driving the display to bypass the lock input signal Lock(IN) supplied from the timing controller 140, thereby transmitting to the second source driving integrated circuit SDIC2 as an output signal Lock.

In this case, the timing controller 140 may supply the lock input signal Lock(IN) in the form of a pulse, but does not transmit the data packet DP during the bypass period.

Accordingly, the first source driving integrated circuit SDIC1 outputs the lock input signal Lock(IN) in the form of a pulse transmitted from the timing controller 140 during the bypass period as it is, and transmits it to the second source driving integrated circuit SDIC2.

The clock recovery circuit 131*b* of the second source driving integrated circuit SDIC2 may generate an internal clock signal using the data packet DP transmitted from the timing controller 140 during the display driving period, and may transfer a high-level logic signal to the AND gate 132*b* if the internal clock signal is normally generated.

The AND gate 132*b* of the second source driving integrated circuit SDIC2 may receive an output signal of the clock recovery circuit 131*b* and a lock signal Lock transmitted from the first source driving integrated circuit SDIC1, and may generate a high level lock output signal Lock(OUT) and transmit it to the timing controller 140 in the case that the internal clock signal is normally generated and a high level lock signal Lock is input from the first source driving integrated circuit SDIC1.

In this case, the mode switch SWm2 connected to the AND gate 132*b* is turned on during the bypass period to bypass the lock signal Lock transmitted from the first source driving integrated circuit SDIC1, thereby transmitting the lock output signal Lock(OUT) to the timing controller 140. Accordingly, during the bypass period, the first source driving integrated circuit SDIC1 and the second source driving integrated circuit SDIC2 may bypass the pulse-type lock input signal Lock(IN) transmitted from the timing controller 140 through the turned-on mode switches SWm1 and SWm2 and may feedback it to the timing controller 140.

Accordingly, the timing controller 140 may detect the delay time Td by comparing the lock input signal Lock(IN) supplied to the data driving circuit 130 during the bypass period and the lock output signal Lock(OUT) fed back from the data driving circuit 130.

The timing controller 140 may determine the output characteristics of the data packet DP based on the delay time Td of the signal detected in the bypass period, and may transfer the data packet DP to the data driving circuit 130 in the display driving period.

Figure 7:
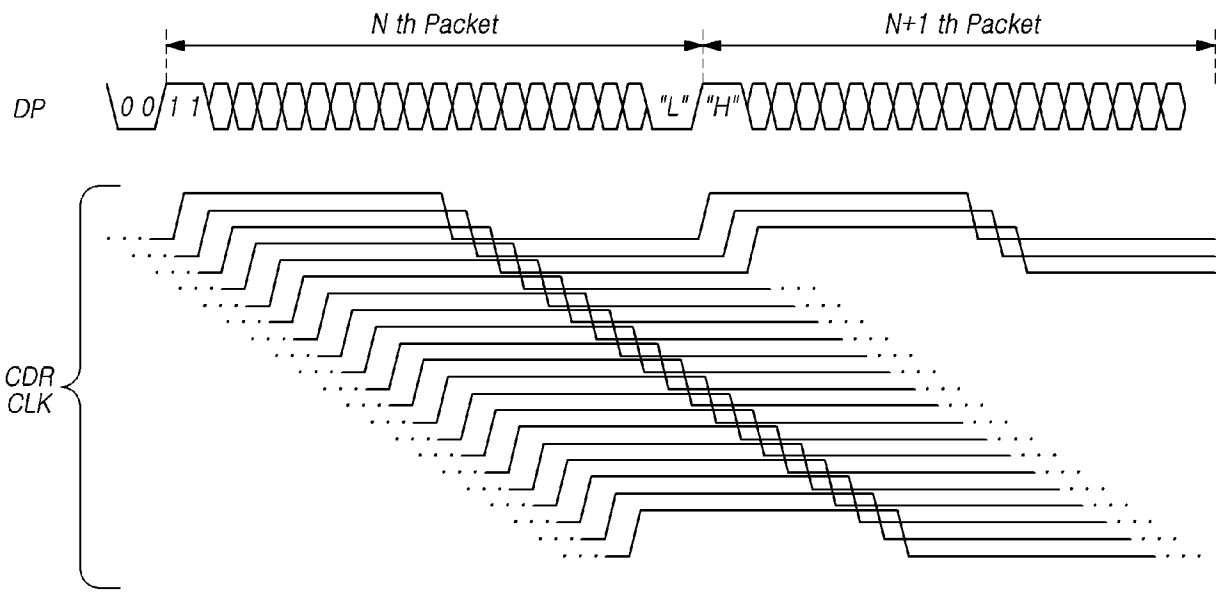
FIG. 7 illustrates an example of a waveform of an internal clock restored through a clock recovery circuit in a display device according to embodiments of the present disclosure.

FIG. 7 illustrates an example of a waveform of an internal clock restored through a clock recovery circuit in a display device according to embodiments of the present disclosure.

Referring to FIG. 7, in the display device 100 according to embodiments of the present disclosure, the clock recovery circuits 131*a*, 131*b* included in the source driving integrated circuits SDIC1, SDIC2 generate an internal clock CDR CLK by using the clock training pattern of the data packet DP transmitted from the timing controller 140.

In this case, the source driving integrated circuits SDIC1, SDIC2 may, if a phase of the internal clock CDR CLK is the same as the input clock included in the data packet DP, output a high-level lock signal Lock and generate a multi-phase internal clock CDR CLK.

The multi-phase internal clock CDR CLK may correspond to a clock signal whose phase is sequentially delayed so that a rising edge is synchronized with each bit of the digital image data DATA.

In this case, the source driving integrated circuits SDIC1, SDIC2 may sample the digital image data DATA at the rising edge of the internal clock CDR CLK.

Figure 8:
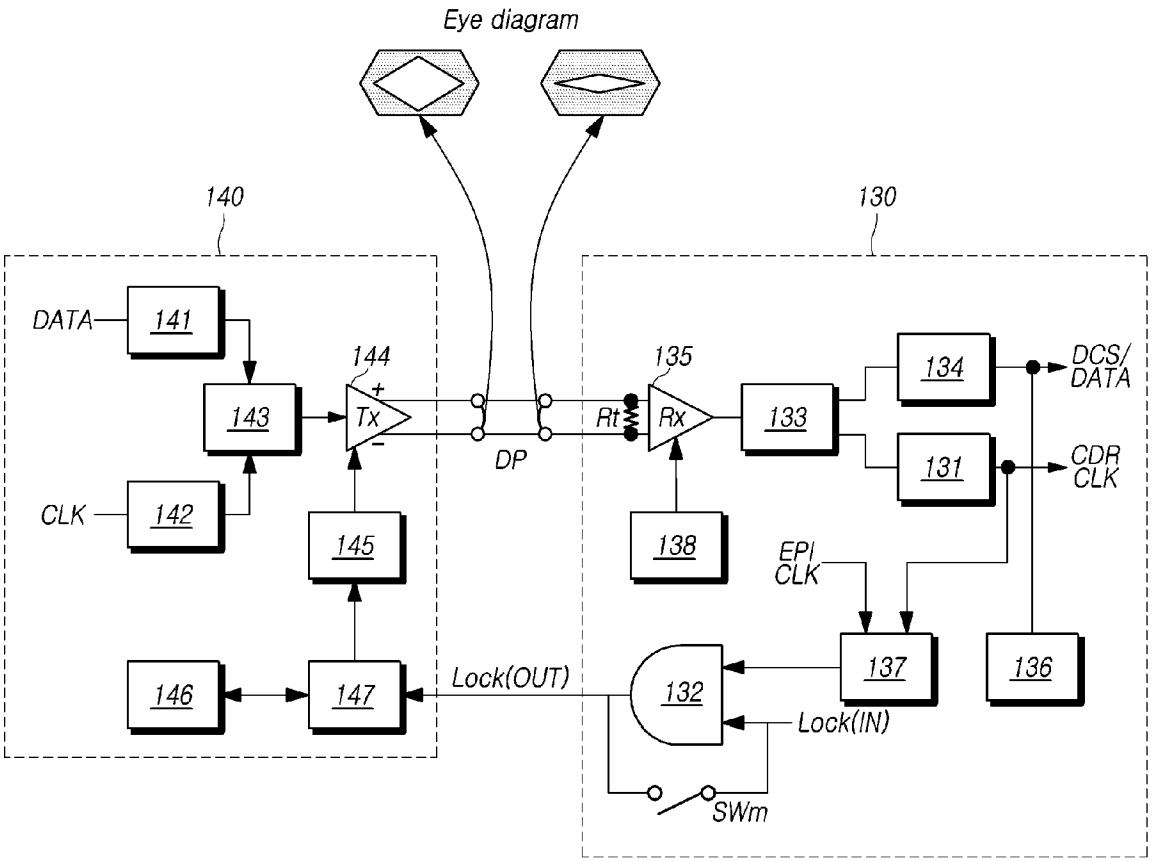
FIG. 8 is a block diagram illustrating an internal configuration of a timing controller and a data driving circuit in a display device according to embodiments of the present disclosure.

FIG. 8 is a block diagram illustrating an internal configuration of a timing controller and a data driving circuit in a display device according to embodiments of the present disclosure.

Here, it is illustrated by assuming that one source driving integrated circuit SDIC is disposed in the data driving circuit 130 to directly exchange signals with the timing controller 140. However, as described above, a plurality of source driving integrated circuits SDIC may be located in the data driving circuit 130, and in this case, the plurality of source driving integrated circuits SDIC may have the same circuit configuration.

Referring to FIG. 8, in the display device 100 according to embodiments of the present disclosure, the timing controller 140 may include a data processing circuit 141, a clock generation circuit 142, a packer 143, a transmission buffer 144, an output characteristic changing circuit 145, an output characteristic control circuit 147, and memory 146.

The data processing circuit 141 may align the clock training pattern CT, the data control signal DCS, and the digital image data DATA in a serial data bit stream and may supply it to the packer 143.

The clock generation circuit 142 may supply bits of an input clock EPI CLK to the packer 143.

The packer 143 may embed the bits of the input clock EPI CLK in the serial data signal and supply it to the transmission buffer 144 so as to satisfy the signal transmission protocol of the point-to-point interface.

The transmission buffer 144 converts the serial data signal input from the packer 143 into a data packet DP of a differential signal and transmits it to the data driving circuit 130 through a paired signal line.

In this case, the output characteristic changing circuit 145 may change output characteristics such as differential input voltage VID and pre-emphasis PE. For example, the output characteristic changing circuit 145 may vary the differential input voltage VID and the pre-emphasis PE by adjusting the driving voltage or the gain of the transmission buffer 144.

To this end, the output characteristic control circuit 147 may control the output characteristic changing circuit 145 to change the output characteristic values for the differential input voltage VID and the pre-emphasis PE according to a predetermined reference.

In this case, the output characteristic control circuit 147 may determine an output characteristic of the data packet DP based on the delay time Td between the lock input signal Lock(IN) supplied to the data driving circuit 130 and the lock output signal Lock(OUT) received from the data driving circuit 130.

Accordingly, the timing controller 140 transmits the data packet DP to the data driving circuit 130 according to the output characteristics determined by considering the delay time Td of the lock input signal Lock(IN) and the lock output signal Lock(OUT).

The data driving circuit 130 or the source driving integrated circuit SDIC may include a receiving buffer 135, a reception characteristic control circuit 138, an unpacker 133, a data processing circuit 134, a clock recovery circuit 131, an error detection circuit 136, a phase comparison circuit 137, and an AND gate 132.

The receiving buffer 135 receives the data packet DP through the paired signal line and supplies it to the unpacker 133. The reception characteristic control circuit 138 may vary reception characteristics such as equalizing EQ and reception resistance of a reception resistor Rt according to the output characteristics received from the timing controller 140 in order to control reception characteristics of the data driving circuit 130.

For example, the reception characteristic control circuit 138 may vary or change the equalizing EQ level by adjusting the gain of the receiving buffer 135 according to the equalizing EQ setting value. The data packet DP received from the timing controller 140 may be amplified according to the equalizing EQ level set by the reception characteristic control circuit 138.

The reception resistor Rt may be connected between both input terminals of the receiving buffer 135 in the data driving circuit 130, and may be implemented as a variable resistor whose resistance value is selected according to the selection signal of the reception characteristic control circuit 138. The reception characteristic control circuit 138 may change the amplitude of the data packet DP by varying the reception resistance of the reception resistor Rt according to the output characteristic received from the timing controller 140.

The unpacker 133 separates the clock training pattern CT, the data control signal DCS, and the digital image data DATA from the data packet DP received through the receiving buffer 135.

Then, the unpacker 133 transmits the input clock EPI CLK included in the clock training pattern CT to the clock recovery circuit 131, and transmits the data control signal DCS and the digital image data DATA to the data processing circuit 134.

The data processing circuit 134 converts digital image data DATA of a serial structure into data of a parallel structure using a shift register and a latch. In this case, the shift register and the latch of the data processing circuit 134 may be synchronized according to the internal clock CDR CLK generated by the clock recovery circuit 131.

The clock recovery circuit 131 generates the internal clock CDR CLK according to the clock training pattern CT received from the unpacker 133, and may control the phase of the internal clock CDR CLK to be synchronized with the input clock EPI CLK.

In this case, if the phase of the internal clock CDR CLK coincides with the phase of the input clock EPI CLK, the clock recovery circuit 131 may lock or fix the phase of the internal clock CDR CLK.

The phase comparison circuit 137 compares the phase of the input clock EPI CLK included in the data packet DP with the phase of the internal clock CDR CLK generated by the clock recovery circuit 131, and generate a high-level output signal if the phases are the same.

On the other hand, if the phase of the input clock EPI CLK and the phase of the internal clock CDR CLK are not the same, the phase comparison circuit 137 generates a low-level output signal.

In the case that a high-level output signal is input from the phase comparison circuit 137 and a high-level lock input signal Lock(IN) is input from the timing controller 140, the AND gate 132 may transmit a high-level lock output signal Lock(OUT) to the timing controller 140.

In this case, in the case that a plurality of source driving integrated circuits SDIC are disposed in the data driving circuit 130, the lock input signal Lock(IN) input to the AND gate 132 may become a lock signal Lock transmitted from an adjacent source driving integrated circuit SDIC.

In this case, the mode switch SWm connected to the AND gate 132 is turned on during the bypass period to bypass the lock input signal Lock(IN) transmitted from the timing controller 140, thereby feeding back the lock output signal Lock(OUT) to the timing controller 140.

The error detection circuit 136 checks whether there is an error in the digital image data DATA output through the data processing circuit 134.

Figure 9:
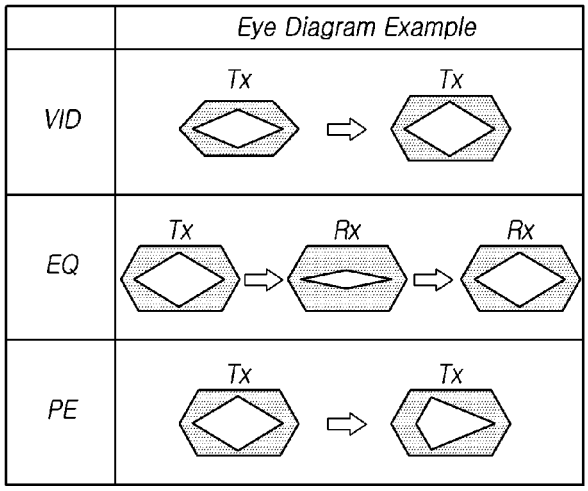
FIG. 9 is an exemplary diagram illustrating an eye diagram according to an output characteristic of a timing controller in a display device according to embodiments of the present disclosure.

FIG. 9 is an exemplary diagram illustrating an eye diagram according to an output characteristic of a timing controller in a display device according to embodiments of the present disclosure. And, FIG. 10 illustrates an example in which an output characteristic of a timing controller is controlled according to a delay time for signal transmission in a display device according to embodiments of the present disclosure.

Referring to FIG. 9 and FIG. 10, in the display device 100 according to embodiments of the present disclosure, the eye diagram may be used as an index indicating signal quality affected by analog characteristics of digital image data DATA including, for example, amplitude, slew rate of rise or falling time, DC level, jitter, etc.

A differential input voltage VID characteristic may represent the maximum voltage of the data packet DP output from the transmission buffer 144 of the timing controller 140, that is, the maximum voltage level between positive voltage (+) and negative voltage (−) of differential input voltage VID.

Accordingly, when the delay time Td of the signal transmitted from the timing controller 140 to the data driving circuit 130 increases, there may increase the differential input voltage VID, thereby compensating for signal attenuation according to the delay time Td.

The equalizing EQ characteristic may indicate an equalizing level of the data packet DP received in the receiving buffer 135 of the data driving circuit 130.

Accordingly, when the delay time Td of the signal transmitted from the timing controller 140 to the data driving circuit 130 increases, it is possible to compensate for signal attenuation according to the delay time Td by increasing the gain of the receiving buffer 135.

The pre-emphasis PE characteristic may indicate the ratio of the maximum peak-peak voltage and the minimum peak-peak voltage in the region where the data packet DP output from the transmission buffer 144 of the timing controller 140 transitions.

Accordingly, when the delay time Td of the signal transmitted from the timing controller 140 to the data driving circuit 130 increases, it is possible to compensate for signal attenuation according to the delay time Td by increasing the ratio of the maximum peak-to-peak voltage to the minimum peak-to-peak voltage.

Figure 11:
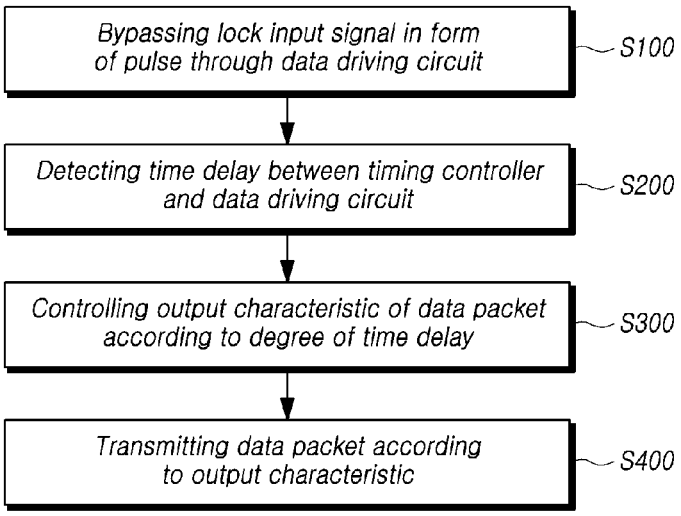
FIG. 11 is a flowchart illustrating a driving method of a display device according to embodiments of the present disclosure.

FIG. 11 is a flowchart illustrating a driving method of a display device according to embodiments of the present disclosure.

Referring to FIG. 11, the driving method of a display device according to embodiments of the present disclosure may include bypassing a lock input signal Lock(IN) in the form of a pulse through the data driving circuit 130 (S100), detecting a delay time Td between a timing controller 140 and the data driving circuit 130 (S200), controlling an output characteristic of the data packet DP according to the degree of the delay time Td (S300), and transmitting the data packet DP according to the output characteristic (S400);

In one embodiment, bypassing the lock input signal Lock(IN) in the form of a pulse through the data driving circuit 130 (S100) may mean a process in which the data driving circuit 130 bypasses the lock input signal Lock(IN) transmitted from the timing controller 140 in order to determine the signal transmission characteristic between the timing controller 140 and the data driving circuit 130, prior to a display driving period in which the data packet DP is transmitted to the data driving circuit 130. Accordingly, the data driving circuit 130 feeds back the lock output signal Lock(OUT) having the same waveform as the lock input signal Lock(IN) transmitted from the timing controller 140 to the timing controller 140.

In this case, the lock input signal Lock(IN) generated by the timing controller 140 during the bypass period may be transmitted in the form of a pulse in order to more accurately and quickly detect the delay time Td with the lock output signal Lock(OUT) transmitted from the data driving circuit 130.

In one embodiment, detecting a delay time Td between a timing controller 140 and the data driving circuit 130 (S200) is a process for detecting the delay time Td in which the lock input signal Lock(IN) generated by the timing controller 140 in the bypass period is delayed while passing through the data driving circuit 130 and a signal line (e.g., FFC) connecting the control printed circuit board CPCB and the source printed circuit board SPCB.

Accordingly, when receiving the lock output signal Lock (OUT) transmitted from the data driving circuit 130 after a predetermined delay time Td, the timing controller 140 may detect the delay time Td occurring in the signal transmission process to the data driving circuit 130 by comparing the lock input signal Lock(IN) and the lock output signal Lock (OUT).

In one embodiment, controlling an output characteristic of the data packet DP according to the degree of the delay time Td (S300) may be a process, depending on the degree of delay time Td, for setting the output characteristic of the data packet DP transmitted to the data driving circuit 130 during the display driving period based on the delay time Td between the lock input signal Lock(IN) transmitted from the timing controller 140 in the bypass period and the lock output signal Lock(OUT) received from the data driving circuit 130.

The transmitting the data packet DP according to the output characteristics (S400) is a process for transmitting the data packet DP to the data driving circuit 130 according to the set output characteristics in the display driving period after the bypass period.

Accordingly, the data driving circuit 130 may synchronize the internal clock CDR CLK through clock training for the clock training pattern CT included in the received data packet DP, and may receive the data control signal DCS and the digital image data DATA according to the synchronized clock.

As described above, the timing controller 140 may determine the characteristics of the signal being transmitted to the data driving circuit 130 during the bypass period before transmitting the data packet DP. Therefore, it is possible to actively control the output characteristics of the data packet DP transmitted to the data driving circuit 130 and improve the image quality of the display device 100.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel in which a plurality of gate lines, a plurality of data lines, and a plurality of subpixels are disposed;

a gate driving circuit configured to drive the plurality of gate lines;

a data driving circuit configured to drive the plurality of data lines, bypassing a lock input signal in a first period without receiving a data packet during the first period, and receiving the data packet in a second period following the first period; and a timing controller configured to control the gate driving circuit and the data driving circuit, detecting a delay time of the lock input signal bypassed through the data driving circuit in the first period by using a point-to-point interface which serializes digital image data and inserts clock information to transmit the data packet, and controlling an output characteristic of the data packet transmitted to the data driving circuit in the second period, wherein during the first period, the timing controller is configured to transmit the lock input signal without transmitting the data packet to the data driving circuit, and a plurality of source driving integrated circuits included in the data driving circuit each include a corresponding clock recovery circuit that is bypassed as the lock input signal is transmitted through each of the plurality of source driving integrated circuits without using the corresponding clock recovery circuit, and the lock input signal that is transmitted through the plurality of source driving integrated circuits is output as a lock output signal to the timing controller.

2. The display device of claim 1, wherein the plurality of source driving integrated circuits are connected in series, wherein the lock input signal is sequentially transmitted through the plurality of source driving integrated circuits, and the data packet is transmitted from the timing controller to the plurality of source driving integrated circuits, respectively.

3. The display device of claim 1, wherein the lock input signal is transmitted in a form of a pulse during the first period.

4. The display device of claim 1, wherein the data packet comprises a clock training pattern for synchronizing an internal clock, a data control signal for controlling the data driving circuit, and the digital image data for displaying an image on the display panel.

5. The display device of claim 4, wherein each of the plurality of source driving integrated circuits comprises:

the corresponding clock recovery circuit configured to generate the internal clock using the data packet and generating a high level lock output signal if a phase of the internal clock is locked;

a logic circuit configured to receive an output of the clock recovery circuit and the lock input signal; and a mode switch connected to an output node of the logic circuit and the lock input signal to bypass the lock input signal in the first period.

6. The display device of claim 5, wherein the high level lock output signal is a signal indicating whether the phase of the internal clock is locked.

7. The display device of claim 6, wherein the data driving circuit comprises:

a receiving buffer configured to receive the data packet;

a reception characteristic control circuit configured to control reception characteristics of the receiving buffer;

an unpacker configured to separate the data packet transmitted through the receiving buffer;

a data processing circuit configured to convert the digital image data of a serial structure separated through the unpacker into a data of a parallel structure; and a phase comparison circuit configured to compare a phase of an input clock included in the data packet and a phase of the internal clock.

8. The display device of claim 1, wherein the output characteristic includes at least one of:

a differential input voltage characteristic indicating a maximum voltage level of the data packet output from the timing controller, an equalizing characteristic indicating an equalizing level of the data packet received by the data driving circuit, and a pre-emphasis characteristic indicating a ratio of a maximum peak-to-peak voltage and a minimum peak-to-peak voltage of the data packet output from the timing controller.

9. The display device of claim 8, wherein a characteristic value of the output characteristic increases as the delay time of the lock input signal increases.

10. The display device of claim 1, wherein the timing controller comprises:

a data processing circuit configured to align a clock training pattern, a data control signal, and the digital image data into a serial data signal;

a clock generation circuit configured to generate an input clock of the data packet;

a packer configured to embed the input clock in the serial data signal;

a transmission buffer configured to convert the serial data signal input from the packer into the data packet of a differential signal and transmitting the data packet; and an output characteristic control circuit configured to control output characteristic of the data packet.

11. A driving circuit comprising:

a clock recovery circuit configured to generate an internal clock using a data packet received during a display driving period, and generating a high level lock output signal when a phase of the internal clock is locked through a point-to-point interface which serializes digital image data and inserts clock information to transmit a data packet;

a logic circuit configured to receive an output of the clock recovery circuit and a lock input signal; and a mode switch connected to an output node of the logic circuit and the lock input signal to bypass the lock input signal in a bypass period, wherein during the bypass period, the driving circuit is configured to receive the lock input signal without receiving the data packet from a timing controller, and the clock recovery circuit is bypassed as the lock input signal is transmitted through the driving circuit via the mode switch without using the clock recovery circuit.

12. The driving circuit of claim 11, wherein the lock input signal is transmitted in a form of a pulse during the bypass period.

13. The driving circuit of claim 11, further comprising:

a receiving buffer configured to receive the data packet;

a reception characteristic control circuit configured to control reception characteristics of the receiving buffer;

an unpacker separating the data packet transmitted through the receiving buffer;

a data processing circuit configured to convert the digital image data of a serial structure separated through the unpacker into a data of a parallel structure; and a phase comparison circuit configured to compare a phase of an input clock included in the data packet and a phase of the internal clock.

14. A driving method of a display device which serializes digital image data and inserts clock information to transmit a data packet in a point-to-point interface comprising:

transmitting, by a timing controller of the display device during a first period, a lock input signal that is in a form of a pulse to a data driving circuit of the display device without transmitting a data packet to the data driving circuit during the first period, the data driving circuit including a plurality of source driving integrated circuits that each include;

bypassing, during the first period, the corresponding clock recovery circuit included in each of the plurality of source driving integrated circuits as the lock input signal is transmitted through the plurality of source driving integrated circuits of the data driving circuit during the first period, wherein the lock input signal that is transmitted through the plurality of source driving integrated circuits during the first period is output as a first lock output signal to the timing controller during the first period;

detecting a delay time between the timing controller and the data driving circuit during the first period based on the first lock output signal;

controlling output characteristic of the data packet according to a degree of the delay time; and transmitting, by the timing controller, the data packet to the data driving circuit according to the output characteristic in a second period that follows the first period, wherein during the second period that follows the first period, each corresponding clock recovery circuit is configured to generate an internal clock using the data packet and generate a second lock output signal if a phase of the internal clock is locked.

15. The driving method of claim 14, wherein the data packet comprises a clock training pattern for synchronizing an internal clock, a data control signal for controlling the data driving circuit, and the digital image data for displaying an image on a display panel.

16. The driving method of claim 14, wherein the output characteristic includes at least one of:

a differential input voltage characteristic indicating a maximum voltage level of the data packet output from the timing controller, an equalizing characteristic indicating an equalizing level of the data packet received by the data driving circuit, and a pre-emphasis characteristic indicating a ratio of a maximum peak-to-peak voltage and a minimum peak-to-peak voltage of the data packet output from the timing controller.

17. The driving method of claim 16, wherein a characteristic value of the output characteristic increases as the delay time increases.

* * * * *